US007859361B2

(12) United States Patent
Evers et al.

(10) Patent No.: US 7,859,361 B2
(45) Date of Patent: Dec. 28, 2010

(54) DIRECTIONAL COUPLER

(75) Inventors: Christian Evers, Heimstetten (DE); Ralf Juenemann, Munich (DE); Alexander Bayer, Munich (DE); Markus Leipold, Isen (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 128 days.

(21) Appl. No.: 12/303,052

(22) PCT Filed: Aug. 6, 2007

(86) PCT No.: PCT/EP2007/006936

§ 371 (c)(1),
(2), (4) Date: Dec. 19, 2008

(87) PCT Pub. No.: WO2008/019777

PCT Pub. Date: Feb. 21, 2008

(65) Prior Publication Data

US 2009/0206947 A1 Aug. 20, 2009

(30) Foreign Application Priority Data

Aug. 14, 2006 (DE) ..... 10 2006 038 029

(51) Int. Cl.
*H01P 5/04* (2006.01)
*H01P 5/18* (2006.01)

(52) U.S. Cl. ..... 333/109; 333/111

(58) Field of Classification Search ..... 333/109, 333/110, 111, 113, 115
See application file for complete search history.

(56) References Cited

U.S. PATENT DOCUMENTS 3,390,356 A 6/1968 Ryals et al.

(Continued)

FOREIGN PATENT DOCUMENTS

DE 1 183 145 12/1964

(Continued)

OTHER PUBLICATIONS

International Search Report or PCT/EP2007/006936 dated October 24, 2007.

*Primary Examiner*—Dean O Takaoka
(74) *Attorney, Agent, or Firm*—Marshall, Gerstein & Borun LLP

(57) ABSTRACT

In a directional coupler with two coupled lines arranged in a flat chamber of an enclosed metal housing within the coupling region side-by-side in the longitudinal direction and at a spacing distance from one another, of which the ends are connected to connecting ports attached at the sides of the metal housing, these coupled lines include flat, sheet-metal strip conductors, which are arranged within the coupling region with their broad sides facing towards one another side-by-side at a spacing distance and held by several support elements made of insulating material in a cantilever manner at a spacing distance from the opposing internal walls of the flat metal-housing chamber within the latter. In this context, at least one strip conductor is curved relative to the opposing strip conductor in such a manner that the spacing distance of the strip conductors in coupling region increases starting from the beginning of the coupling region approximately exponentially up to the end of the coupling region. The width of the two strip conductors increases within the coupling region.

10 Claims, 1 Drawing Sheet

U.S. PATENT DOCUMENTS

| | | | | |
|---|---|---|---|---|
| 4,001,730 | A | 1/1977 | Spinner | |
| 4,349,793 | A * | 9/1982 | Spinner | 333/111 |
| 4,459,568 | A | 7/1984 | Landt | |
| 4,635,006 | A * | 1/1987 | Praba | 333/111 |
| 5,539,148 | A | 7/1996 | Konishi et al. | |
| 7,002,433 | B2 | 2/2006 | Antkowiak et al. | |
| 7,015,771 | B2 * | 3/2006 | Pelz | 333/111 |
| 2003/0034856 | A1 | 2/2003 | Borodulin et al. | |
| 2005/0040912 | A1 | 2/2005 | Pelz | |

FOREIGN PATENT DOCUMENTS

| | | |
|---|---|---|
| DE | 1183145 | 12/1964 |
| EP | 1503447 | 2/2005 |
| FR | 2470453 | 5/1981 |
| GB | 1168811 | 10/1969 |
| WO | WO-84/03395 | 8/1984 |

* cited by examiner

DIRECTIONAL COUPLER

BACKGROUND OF THE INVENTION

1. Field of the Invention

The invention relates to a directional coupler.

2. Related Technology

Directional couplers of this kind are known, for example, from Meinke/Grundlach, Taschenbuch der Hochfrequenztechnik [Handbook of High-Frequency Technology], $5^{th}$ edition, pages L29 to L34. An ideal separation of the forward and returning waves in this context is possible only with directional couplers, which allow for a propagation of TEM waves. Hitherto, this has been possible only with directional couplers in coaxial line technology. Directional couplers in microstrip-line or coplanar line technology do not allow a propagation of pure TEM waves. Moreover, directional couplers in coaxial line technology are relatively complex in structure. However, the relatively-simpler structure of directional couplers in microstripline or coplanar line technology has the disadvantage that it does not allow a pure TEM-wave propagation, and, accordingly, the phase constants of the even and odd modes, which are so important for the function of a directional coupler, are not identical.

SUMMARY OF THE INVENTION

The invention provides a directional coupler, with which a pure TEM-wave propagation is possible and which, in spite of this, allows a compact and cost-favorable manufacture and, above all, which provides an extremely broad bandwidth.

Accordingly, the invention provides a directional coupler with two coupled lines arranged in a flat housing chamber of an enclosed housing within a coupling region side-by-side in a longitudinal direction and at a spacing distance from one another, the ends of the coupling lines being connected to connecting ports attached at sides of the housing, wherein the coupled lines are flat, sheet-metal strip conductors arranged within the coupling region with broad sides of the conductors facing toward one another side-by-side at a spacing distance and held by several insulating support elements in a cantilever manner at a spacing distance from opposing internal walls of the flat housing chamber within the housing chamber, wherein the strip conductors are held within the coupling region respectively by several insulating support elements guided in the longitudinal face walls of the housing, wherein the ends of the support elements are attached to the broad sides of the sheet-metal strip conductors.

A directional coupler according to the invention can be manufactured very simply and cost-favorably. It provides extremely low attenuation; and, above all, an extremely broad bandwidth, for example, between 1 GHz and 70 GHz can be achieved.

BRIEF DESCRIPTION OF THE DRAWINGS

The invention is explained in greater detail below with reference to schematic drawings of exemplary embodiments.

DETAILED DESCRIPTION

Figure 1:
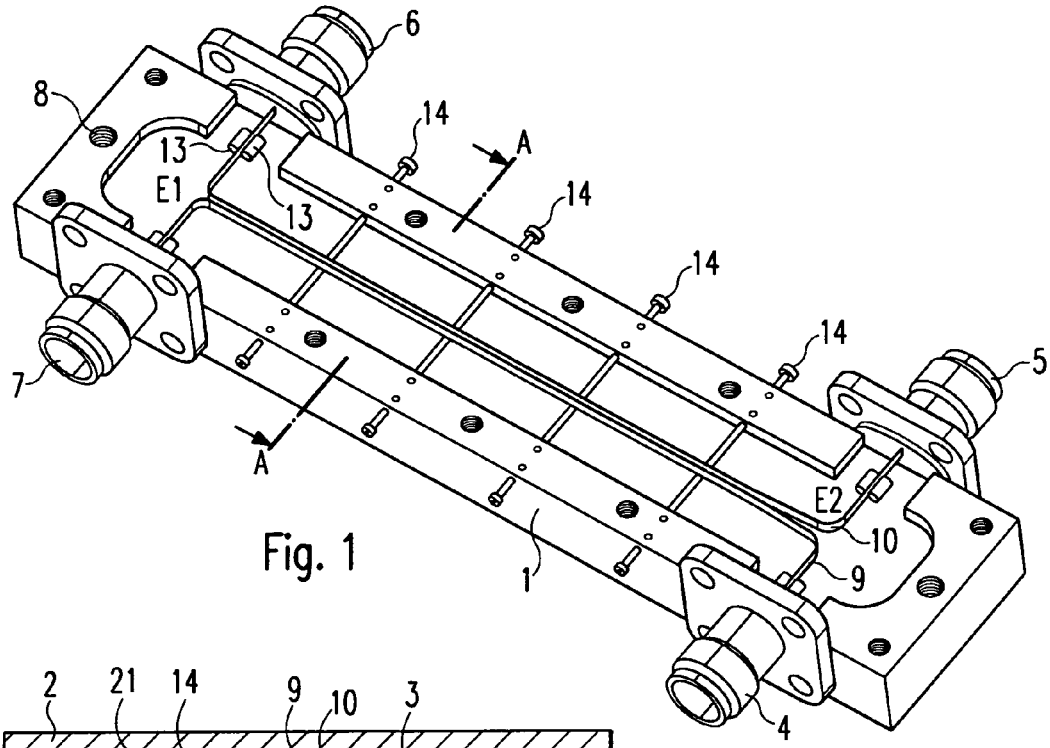
FIG. 1 shows a perspective plan view of a directional coupler according to the invention with the housing cover removed.

FIG. 1 shows a perspective view of a directional coupler according to the invention with a flat metal housing 1 with the cover 2 removed. A flat chamber 3, into which lateral connecting portions, open towards the facing sides of the metal housing, lead, has been milled in the surface of this metal housing 1. Opposite to these connecting portions, in each case externally on the lateral facing surfaces of the metal housing 1, coaxial plug couplings 4-7 are attached, of which the internal conductors project into the connecting portions of the flat chamber 3 of the metal housing. According to FIG. 2, this flat metal housing chamber 3 is enclosed from above by means of a flat cover 2 and screwed down with screws (boreholes 8), which are not illustrated, providing a high-frequency-sealed housing 1. The four coaxial line couplings 4 to 7 form respectively the four high-frequency ports of the directional coupler.

The actual coupled lines are formed by two flat, sheet-metal strip conductors 9 and 10, which are disposed in the coupling region between E1 and E2 with their broad sides facing towards one another side-by-side at a spacing distance.

Figure 2:
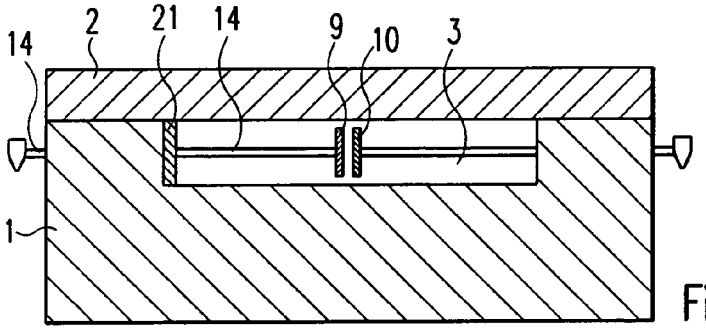
FIG. 2 shows an enlargement of a section along the line A-A in FIG. 1.

As shown in FIG. 2, these two strip conductors 9 and 10 are held standing on end within the coupling region with their broad sides perpendicular to the base of the housing chamber 3 and perpendicular to the internal surface of the attached cover 2 within the metal-housing chamber 3. At the ends of the coupling region E1-E2, these flat, sheet-metal strip conductors are curved laterally outwards and attached to the internal-conductor ends of the coaxial-line couplings 4-7. These flat strip conductors are made of an elastic, flexible sheet-metal material, for example, copper beryllium.

Figure 3:
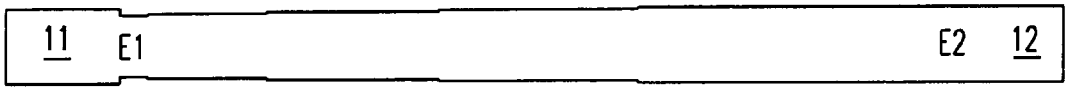
FIG. 3 shows the plan view of one of the two flat sheet-metal strip conductors and, in fact, scaled with reference to width by a factor of approximately 5.

FIG. 3 shows the plan view of an as yet un-curved strip conductor. The width has been enlarged here by a factor of approximately five by way of illustration. The two connecting ends 11 and 12, which are curved during assembly, are of approximately the same width. The actual coupling portion between E1 and E2 has a gradually-increasing width. At the start E1 of the coupling portion, the width is tapered and increases only gradually up to the end E2 of the coupling region, until the width of the connecting end 12 is reached. The width of the connecting ends 11 and 12, and the respective spacing distance relative to the base of the housing chamber 3 or respectively to the internal surface of the cover 2 are selected in such a manner that the connecting ends each provide the same characteristic impedance as the adjoining coaxial-line couplings, in general 50 ohms. The increase in width of the strip conductors 9, 10, which is implemented stepwise in FIG. 3, is approximately linear, but can, of course, also be implemented in a continuous manner.

The two strip conductors 9 and 10 are arranged according to FIG. 1 in the coupling region between E1 and E2 at a spacing distance from one another increasing approximately exponentially from E1 to E2. As shown in FIG. 2, their face sides are held at a predetermined spacing distance relative to the cover and the base of the housing-chamber base and, once again, form a predetermined characteristic impedance system. This approximately exponential characteristic of the spacing distance between the two strip conductors beginning at the narrowest position at the start E1 of the coupling region and the widest position at the end E2 of the coupling region, together with the characteristic illustrated in FIG. 3 of the width of the strip conductors 9, 10, guarantees that the product of $Z_{Even}$ and $Z_{Odd}$ at every position of the coupling system is equal to the square of the system-characteristic impedance, for example, 50 ohms. Accordingly, a good matching and insulation of the directional coupler is guaranteed.

The two flat sheet-metal strip conductors 9 and 10 are held in the flat chamber 3 at the predetermined spacing distances relative to the metal housing 1 and the cover 2 via supporting elements made of an insulating material. In the exemplary embodiment illustrated in FIG. 1, the connecting ends 11, 12 curved respectively laterally outwards from the coupling region E1-E2 are each held via small synthetic-material rollers 13, which are, for example, glued to the metal housing 1 and are in contact at both sides with the broad sides of the strip conductors 9, 10 and preferably also glued to the strip conductors. Within the actual coupling region E1-E2, these strip conductors 9, 10 are held via plungers 14 made of insulating material, which are distributed along the strip conductors at a spacing distance and guided in boreholes in the longitudinal face sides of the metal housing 1. The internal ends of these plungers are disposed in contact with the outward-facing broad sides of the strip conductors 9, 10.

By axial displacement of these plungers, the spacing distance between the strip conductors can be accurately adjusted. The ends of the plungers are preferably once again glued to the broad sides of the strip conductors. With a corresponding pre-tensioning of the elastic, flexible strip conductors, the mere contact of the ends on the strip conductors may optionally also be sufficient for stabilisation. With the illustrated structure, the ports 4 and 5 and the ports 6 and 7 are coupled with one another and the diagonally opposing ports 4 and 6 and 5 and 7 are insulated from one another by the termination of the respectively other ports.

Via these synthetic-material rollers 13 and plungers 14, the strip conductors 9, 10 are fixed in their predetermined position within the metal-housing chamber 3, and a good mechanical stability is achieved. Any electrical influence of these synthetic-material parts, for example, the plungers 14, can be compensated by corresponding small constrictions at the edges of the strip conductors 9, 10.

Figure 4:
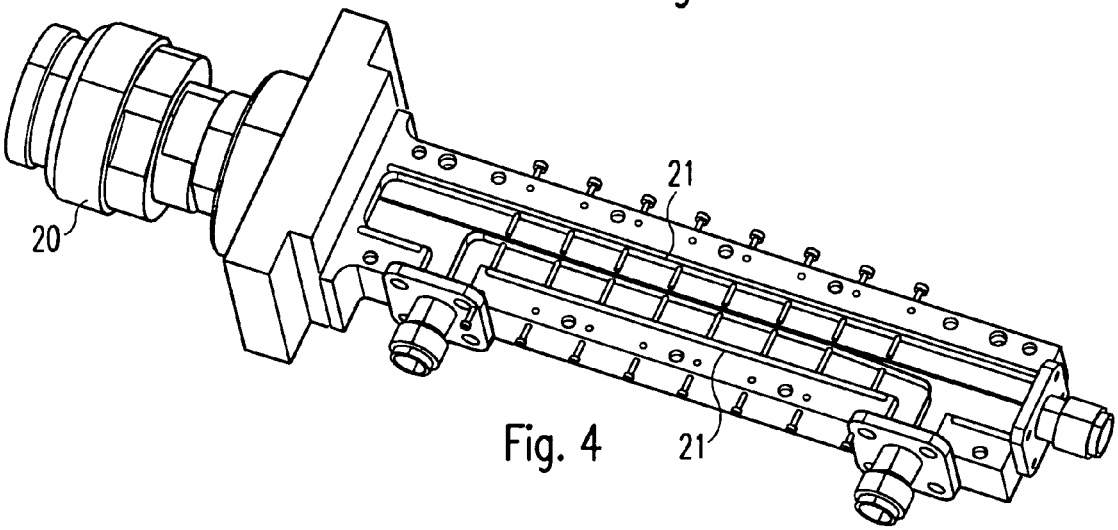
FIG. 4 shows a perspective plan view of a further exemplary embodiment of a directional coupler according to the invention with an integrated solid test port and one straight, continuous strip conductor and only one curved strip conductor.

FIG. 4 shows another embodiment of a directional coupler according to the invention and, in fact, only one of the strip conductors is curved and the other strip conductor is designed to be straight. At the narrow end face of the metal housing 1, a robust test port 20 is attached, of which the internal conductor is connected to the straight strip conductor. The opposite end of the straight strip conductor is connected to a coaxial-line coupling, which is attached at the opposite end-face end of the metal housing. The remaining structure and the mounting of the strip conductors within the housing chamber is as in FIG. 1.

FIG. 4 shows additional ferrite structures 21, which are attached in order to absorb relatively-higher modes along the coupling region on the longitudinal face walls of the metal-housing chamber. Accordingly, the directional coupler can also be operated, even if higher wave modes are theoretically capable of propagation with the selected dimensions.

The directional coupler arrangement according to the invention is also particularly suitable for direct integration in an existing component group, for example, a step attenuator. Moreover, additional terminating resistors can be integrated in the directional coupler, if a signal is only to be coupled into one direction. Moreover, the integration of an attenuation element at one or more connecting ports is possible. Such terminating resistors or attenuation elements can be integrated, for example, directly in the connecting ends 11, 12 of the strip conductors 9, 10.

The invention claimed is:

1. Directional coupler with two coupled lines arranged in a flat housing chamber of an enclosed housing within a coupling region side-by-side in a longitudinal direction and at a spacing distance from one another, respective ends of the coupled lines being connected to connecting ports attached at the sides of the housing, wherein the coupled lines comprise flat, sheet-metal strip conductors arranged within the coupling region with broad sides thereof facing toward one another side-by-side at a spacing distance and held by several support elements made of insulating material in a cantilever manner at a spacing distance from the opposing internal walls of the flat housing chamber within the housing chamber, wherein the strip conductors are held within the coupling region respectively by several support elements made of insulating material guided in the longitudinal face walls of the housing, and wherein the ends of the support elements are attached to the broad sides of the sheet-metal strip conductors.

2. Directional coupler according to claim 1, wherein the housing is a metal housing and the strip conductors are held within the coupling region standing on end with their broad sides perpendicular to the base and the cover of the flat metal housing chamber within the housing chamber.

3. Directional coupler according to claim 1, wherein at least one strip conductor is curved relative to the opposite strip conductor in such a manner that the spacing distance of the strip conductors within the coupling region increases starting from the beginning of the coupling region approximately exponentially up to the end of the coupling region.

4. Directional coupler according to claim 1, wherein the width of the two strip conductors is respectively of the same magnitude at the connecting ends and, within the coupling region, starting at the beginning of the coupling region with a relatively-smaller width by comparison with the width of the connecting ends, increases up to the width of the connecting end at the end of the coupling region.

5. Directional coupler according to claim 1, wherein the strip conductors are made of an elastic, flexible sheet metal.

6. Directional coupler according to claim 1, wherein the housing is a metal housing and that the strip conductors are held at the connecting ends via insulating-material elements attached to the metal housing.

7. Directional coupler according to claim 1, wherein the housing is a metal housing and that the longitudinal face walls of the metal housing chamber are lined with a ferrite material.

8. Directional coupler according to claim 1, wherein the housing is a metal housing and the strip conductors are curved respectively outwardly at the beginning and end of the coupling region and connected to the internal conductors of coaxial-line couplings attached at the sides of the metal housing.

9. Directional coupler according to claim 1, wherein at least at one connecting end of at least one of the two strip conductors, a terminating resistor and/or an attenuation element is integrated in the strip conductor.

10. Directional coupler according to claim 5, wherein the strip conductors comprise copper beryllium.

* * * * *